United States Patent [19]

Shimizu

[11] 4,060,993

[45] Dec. 6, 1977

[54] WATER SEAL PACKING FOR SEALING WATER AT THE COUPLING PORTION OF UNDERWATER STRUCTURES

[75] Inventor: Soichiro Shimizu, Tokyo, Japan

[73] Assignee: Tokyo Fabric Kogyo Kabushiki Kaisha, Tokyo, Japan

[21] Appl. No.: 749,896

[22] Filed: Dec. 13, 1976

[30] Foreign Application Priority Data

Mar. 8, 1976 Japan ..... 51-26449[U]

[51] Int. Cl.[2] ..... E02D 25/00; F16L 49/00

[52] U.S. Cl. ..... 61/43; 61/45 R; 177/166; 285/114; 285/230

[58] Field of Search ..... 61/43, 42, 45 R, 84, 61/85; 277/166; 285/114, 187, 230, 236

[56] References Cited

U.S. PATENT DOCUMENTS

| | | | |
|---|---|---|---|
| 2,698,194 | 12/1954 | Becker | 277/166 X |
| 3,729,939 | 1/1973 | Shimizu | 61/43 |
| 3,920,252 | 11/1975 | Dechavanne | 277/166 X |

*Primary Examiner*—Dennis L. Taylor
*Attorney, Agent, or Firm*—Armstrong, Nikaido & Marmelstein

[57] ABSTRACT

A water seal packing for sealing water at the coupling portion of underwater structures comprising first and second structures; said water seal coupling comprising a first flange, an intermediate body portion, a flexible U-shaped portion and a second flange; each component being formed integrally with each other, said first flange being fixedly secured to said first underwater structure while said second flange being fixedly secured to said second underwater structure.

3 Claims, 11 Drawing Figures

WATER SEAL PACKING FOR SEALING WATER AT THE COUPLING PORTION OF UNDERWATER STRUCTURES

BACKGROUND OF THE INVENTION

This invention relates to a water seal packing for sealing water at the coupling portion of underwater structures such as tunnels or the like disposed under a sea or river.

In general, when tunnel is constructed under water, there has been employed a common process for excavating a rock layer under the sea bed, a shield process for excavating earth and sand for temporarily shutting off the waterway when constructing tunnel tubes. There has recently been developed, however, a process for placing tunnel tubes under the sea bed wherein tubes are connected to each other under water so as to constitute a tunnel.

In such a process for setting the tube, a serious problem takes place which relates to obtaining a device for positively sealing water out of the coupling portion of tunnel tubes even if the tunnel tubes tend to be separated from each other due to extension and contraction of the tunnel tubes.

U.S. Pat. No. 3,729,939 has proved effective for positively sealing water out at the coupling portion of tunnel tube, however, the device in said patent is not effective enough to allow movements of the tunnel tubes, i.e. the device can not follow a large displacement of the tunnel tubes.

SUMMARY OF THE INVENTION

It is, therefore, an object of the present invention to provide a device for sealing water out at the coupling portion of tunnel tubes.

Another object of the present invention is to provide a device for sealing water out at the coupling portion of tunnel tubes which will positively seal water out while the coupling portion is being bent, even if the bending forces act upon the coupling portion of the tunnel tubes, without any difficulty.

It is a further object of the present invention to provide a device for sealing water out at the coupling portion of tunnel tubes which will restrict the separating movement of the tunnel tubes from each other within a predetermined range with the coupling portion of the tunnel tubes remaining bendable.

It is a still further object of the present invention to provide a device for sealing water out at the coupling portion of tunnel tubes which will allow a relatively large movement of each tunnel tube while maintaining a watertight seal at the coupling portion.

According to one aspect of the present invention, there is provided a water seal packing for sealing water at the coupling portion of underwater structures, comprising first and second structures, each being disposed opositely at the end thereof; said water seal packing comprising an intermediate body portion having a sliding surface at one end thereof, a first flange portion formed integrally with said intermediate body portion at a base end thereof, said first flange portion being fixedly secured to said first underwater structure, a flexible U-shaped portion formed integrally with said intermediate portion at the other end thereof adjacent to the sliding surface, and a second flange portion formed integrally with said U-shaped portion at a side opposite to said intermediate body portion, said second flange portion being fixedly secured to said second underwater structure wherein the sliding portion of said intermediate body portion is adapted to slide back and forth on the surface of said second structure.

Other objects, features and advantages of the present invention will be readily apparent from the following description taken in conjunction with the accompanying drawings.

DETAILED DESCRIPTION OF THE PREFERRED EMBODIMENTS

Figure 1:
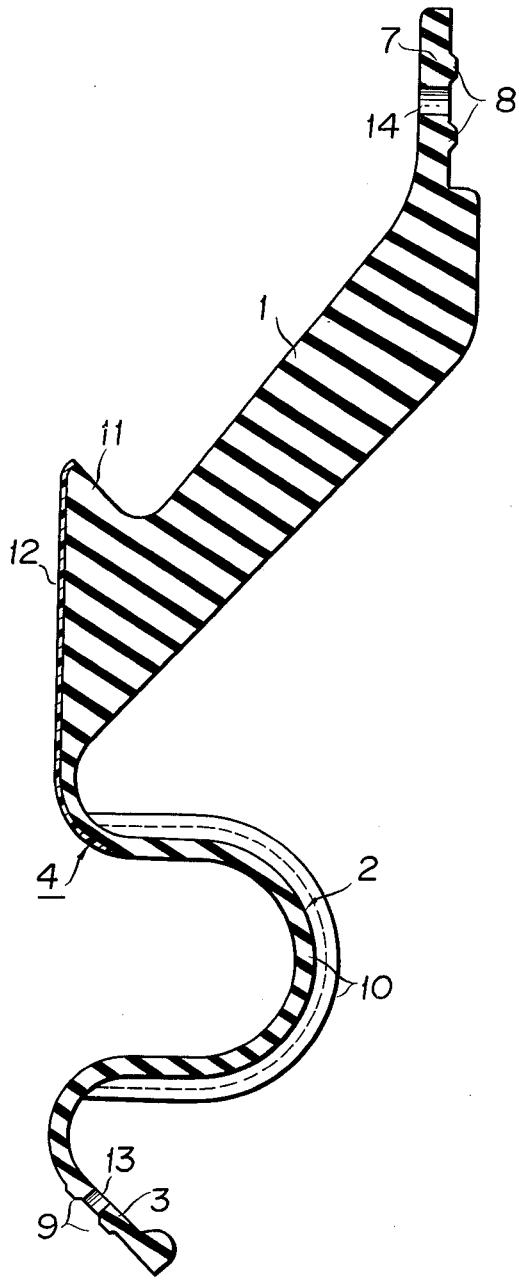
FIG. 1 is a longitudinal cross-sectional side view of a water seal packing according to the present invention.
Figure 2:
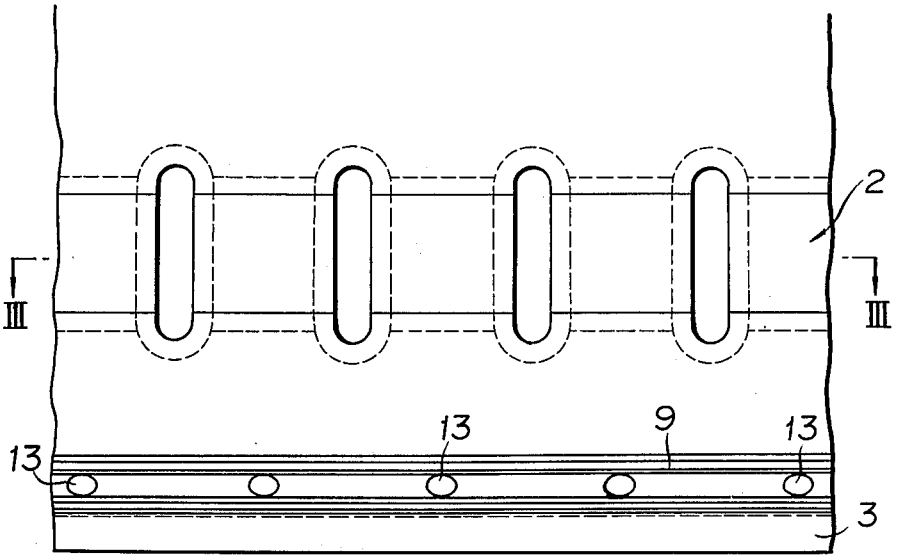
FIG. 2 is a partial plan view of the water seal packing of FIG. 1.
Figure 3:
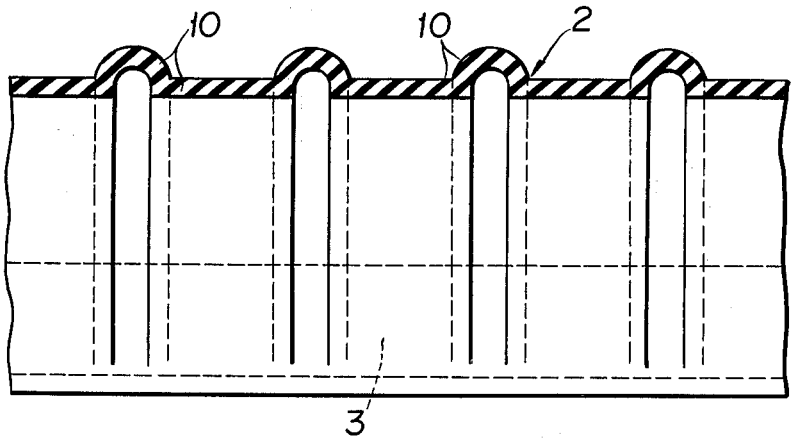
FIG. 3 is a cross-sectional view taken along the line III—III in FIG. 2.

FIGS. 1 to 3 show one example of water seal packings or gaskets made of a resilient material such as rubber etc, which is employed in the present invention. The packing has an inclined intermediate body portion 1, the base or trailing end of which is connected with a base end flange 7 on the back surface of which are formed a pair of water sealing projections 8 extending continuously in the longitudinal direction of the flange. Connected in turn with the leading edge of the inclined intermediate body portion 1 are a U-shaped portion 2 and a leading end flange 3. The flange 3 has also a pair of water sealing projections 9 formed on the back surface thereof and which extend continuously in the longitudinal direction thereof. Further, the above-mentioned U-shaped portion 2 has formed thereon a plurality of wave-shaped portions 10 extending from its one arm to the other. Connected with the back of leading end of the inclined intermediate body portion 1 is a projection 11 for preventing bending of the packing. A sliding layer 12 made of a synthetic resin such as fluororesin is permitted to adhere by baking to the leading surface of the inclined intermediate body portion 1 and the outer surface of the projection 11 connected thereto. The above-mentioned flanges 3 and 7 have a plurality of holes 13 and 14, respectively, through which bolts pass, which are formed at predetermined space intervals in the longitudinal direction of the flanges.

Figure 4:
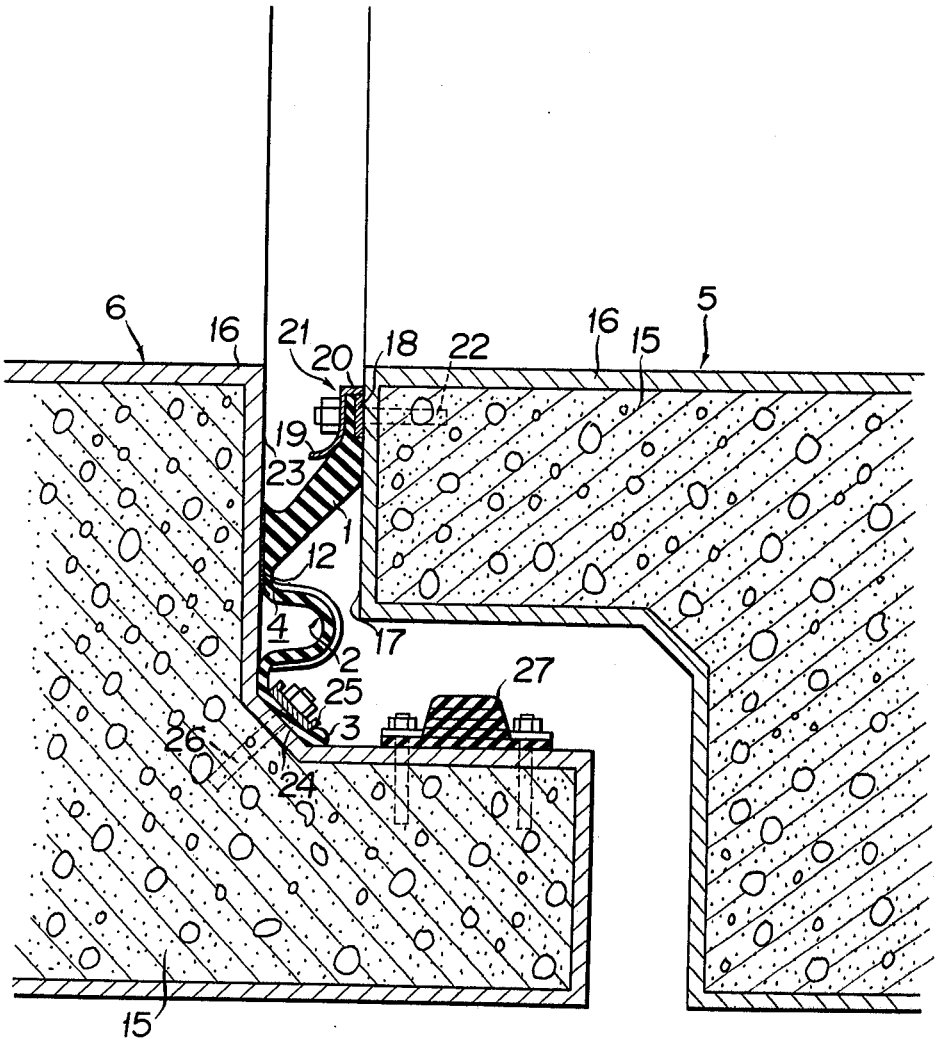
FIG. 4 is a longitudinal cross-sectional side view of an underwater structure employing a water seal packing of the present invention for sealing water out at the coupling portion of the underwater structures.
Figure 5:
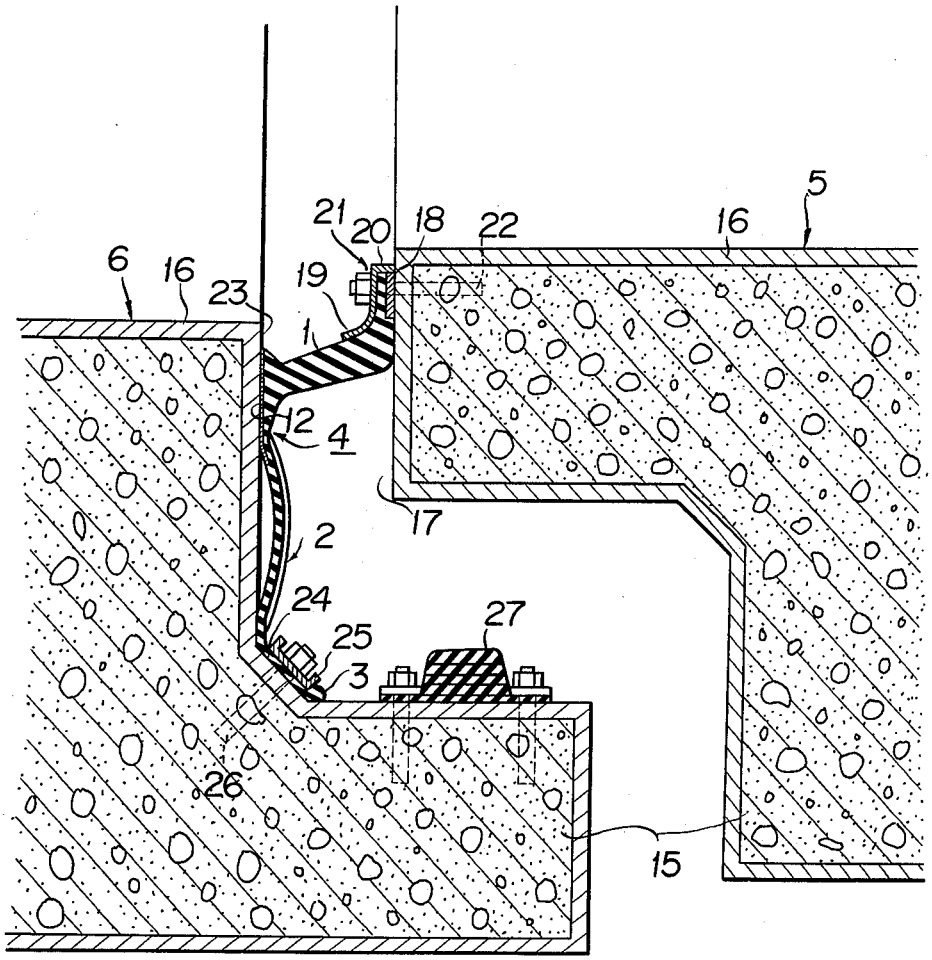
FIG. 5 is similar to FIG. 4 but showing a view wherein the water seal packing is made in an elongated configuration so as to follow the movement of the underwater structures.
Figure 6:
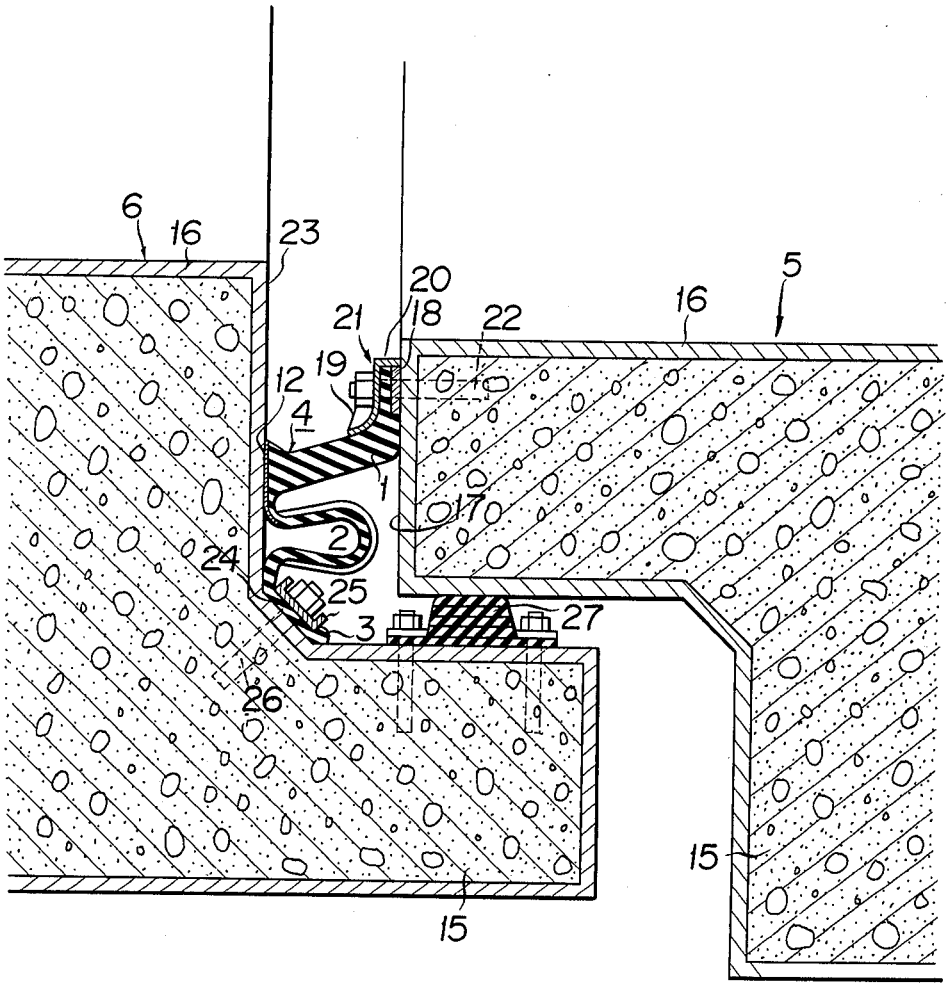
FIG. 6 is similar to FIG. 4 but showing a view wherein the water seal packing is constructed so as to follow the movements of the underwater structure.

FIGS. 4 to 6 illustrate waterproofing flexible or extensible and contractible joint structures for two caissons in which the above-mentioned water seal packing 4 is employed. Underwater structures 5 and 6 each having four-cornered shape in cross section and each comprising a concrete body 15 and a metallic cover plate 16 are disposed in opposed relationship to each other at a predetermined space interval. Abutting against and adhered by welding to end face 17 of a cylindrical portion of a small diameter formed on the inner periphery of one underwater structure 5 is a metallic strip-shaped bearing plate 18 which extends along the entire periphery of the small diameter cylindrical portion. The above-mentioned flange 7 abuts against the strip-shaped bearing plate 18, and the base portion of the inclined intermediate body portion 1 is also engaged with the strip-shaped bearing plate 18. Further, abutting against the entire length of the surface of the base end flange 7 is a metallic retainer member 21 which comprises an arcuate portion 19 disposed opposite to the base end of the inclined intermediate body portion 1 and a bearing portion 20 disposed opposite to the side edge of the base end flange 7. The above-mentioned base end flange 7 is fixedly secured through the retainer member 21 by tightening up an anchor bolt 22 adapted to be fixed to the underwater structure 5.

The above-mentioned leading end flange 3 abuts against an inclined mounting face 24 formed between a cylindrical part of a large diameter disposed on the outer periphery of the end of the other underwater structure 6 and an inner peripheral side surface 23 of the underwater structure 6. The leading end flange 3 is fixedly secured to the inclined mounting face 24 through a retainer member 25 by tightening up an anchor bolt 26 adapted to be secured to the underwater structure 6. Further, the above-mentioned sliding layer 12 abuts against the inner peripheral side surface 23 of the underwater structure 6 so as to slide freely on the latter. A sliding bearing base 27 extending in the direction of width of the large diameter cylindrical portion rests on the upper surface of the lower part of the latter.

If the U-shaped portion 2 has a plurality of wave-shaped sections 10 formed thereon, easier shearing deformation of the water seal packing 4 can be obtained.

Figure 7:
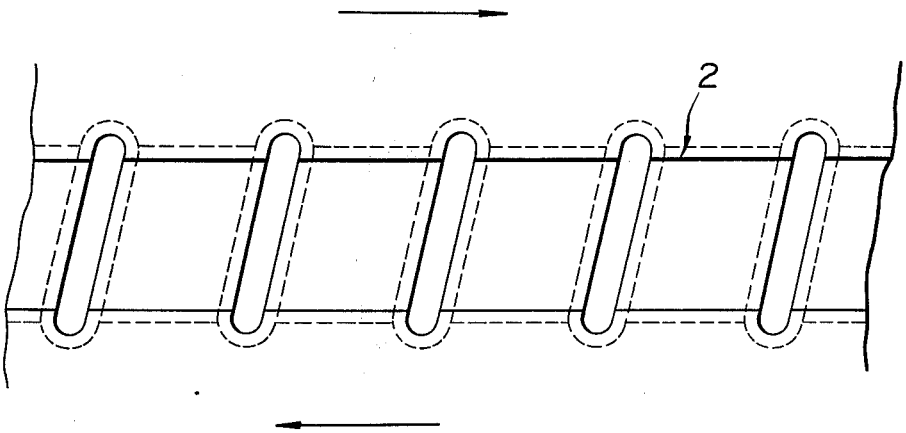
FIG. 7 is a schematic plan view showing a shearing deformation of U-shaped portion of the water seal packing.

According to the present invention, the water seal packing 4 made of a resilient material has U-shaped portion 2 formed thereon so that when tensile force is applied to the region of the water seal packing 4 between the base end and the leading end thereof, the U-shaped portion 2 may be easily expanded or deformed as shown in FIG. 5, whilst if a compressive force is applied to the same region the U-shaped portion 2 is easily deformed or shrinked as shown in FIG. 6. Further, when a shearing force is exerted on the region of the water seal packing 4 between the base or trailing and leading ends thereof in the longitudinal direction, the U-shaped portion 2 will be easily deformed by shearing as shown in FIG. 7. Therefore, when the underwater or submarine structures 5 and 6 are moved vertically or horizontally relative to each other, relatively large widthwise allowable limit of expansion and contraction and longitudinal allowable limit of movement by shearing of the water seal packing 4 can be obtained without causing an excessive stress on the latter. Further, since the leading end of the inclined intermediate body portion can be resiliently moved, even if the space interval between the underwater structures 5 and 6 varies, the water pressure acting on the inclined intermediate body portion 1 enables the leading end of the latter to be forcibly kept always in contact with the end of the underwater structure 6. For this reason, not only more positive water sealing effect can be obtained between the underwater structures 5 and 6, but also the U-shaped portion 2 can be kept under stable condition by the leading end flange 3 and the leading end of the inclined intermediate body portion 1.

Figure 8:
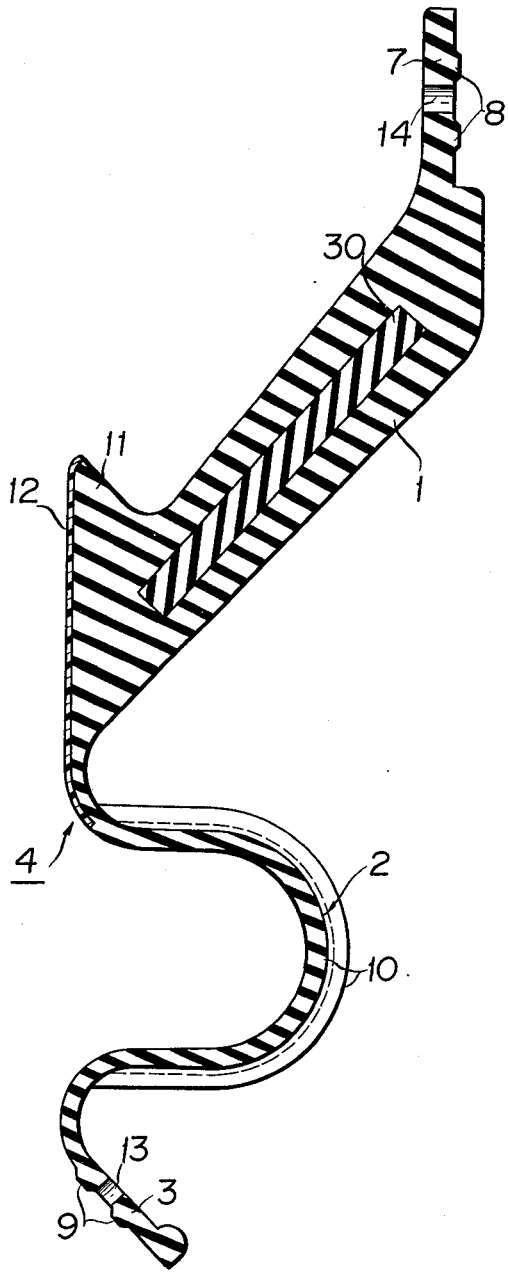
FIG. 8 is similar to FIG. 1 but showing another embodiment of the present invention.

FIG. 8 shows another embodiment of the present invention which differs from the embodiment of FIG. 1 in that a core plate 30 made of fibre reinforced hard rubber is embedded in the inclined intermediate body portion 1. The provision of the core plate 30 serves to restrain the deformation of the inclined intermediate body portion 1 by bending thereby improving the stability of configuration of the water seal packing against the water pressure.

Moreover, since the section of the inclined intermediate body portion 1 can be maintained in almost rectilinear configuration without being bent to a large extent by the water pressure, the oscillating force of the inclined intermediate body portion 1 when it is permitted to oscillate about its base end can be effectively utilized so as to forcibly keep the leading end of the inclined intermediate body portion 1 in contact with the underwater structure thereby improving the water sealing effect of the packing.

The hardness of the soft rubber constituting the body of the water seal packing should preferably be in the range of 50° to 70°, whilst the fibre reinforced hard rubber constituting the core plate 30 should preferably be, for example, in the range of 90° to 98°.

Figure 9:
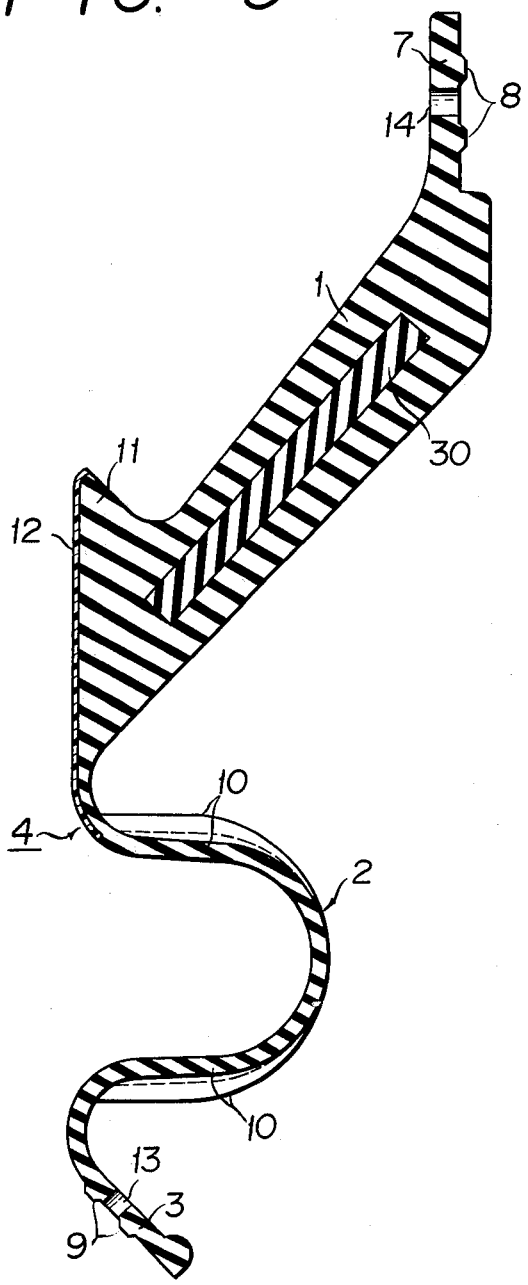
FIG. 9 is similar to FIG. 1 but showing a still another embodiment of the present invention.

FIG. 9 illustrates a further embodiment of the present invention which differs from the embodiment of FIG. 8 in that wave-shaped sections 10 are not formed continuously on the entire length of the section of the U-shaped portion 2. The other construction of this embodiment is the same as that of FIG. 8.

Figure 10:
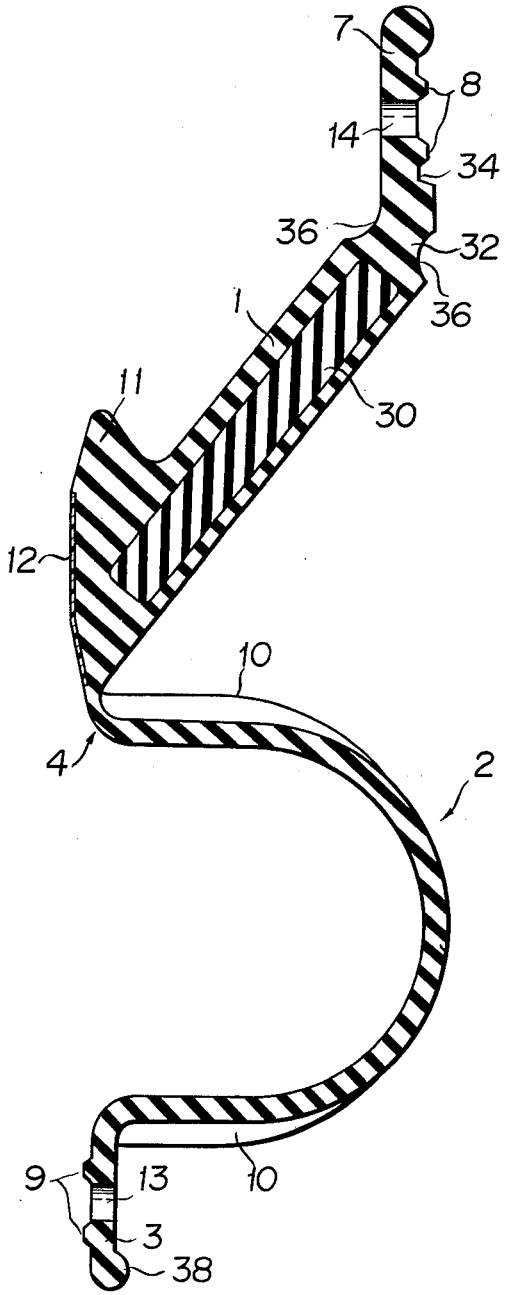
FIG. 10 is similar to FIG. 1 but showing a further embodiment of the present invention.

FIG. 10 illustrates a still further embodiment of the water seal packing or gasket according to the present invention in which a base end flange 7 connected with the base end of the inclined intermediate body portion 1 has on the back surface thereof a groove 34 extending continuously in the longitudinal direction of the packing.

Formed on both surfaces of the portion between the inclined intermediate body portion 1 and the base end flange 7 are arcuate grooves 36 extending continuously in the longitudinal direction of the flange so as to form a thin wall portion 32. The other construction of this example is nearly the same as that of the embodiment shown in FIG. 8. According to this embodiment, since the thin wall portion 32 is formed between the inclined intermediate body portion 1 and the base end flange 7, the resistance of the inclined intermediate body portion to the oscillation thereof can be reduced substantially thereby enabling the inclined intermediate body portion to oscillate easily.

Figure 11:
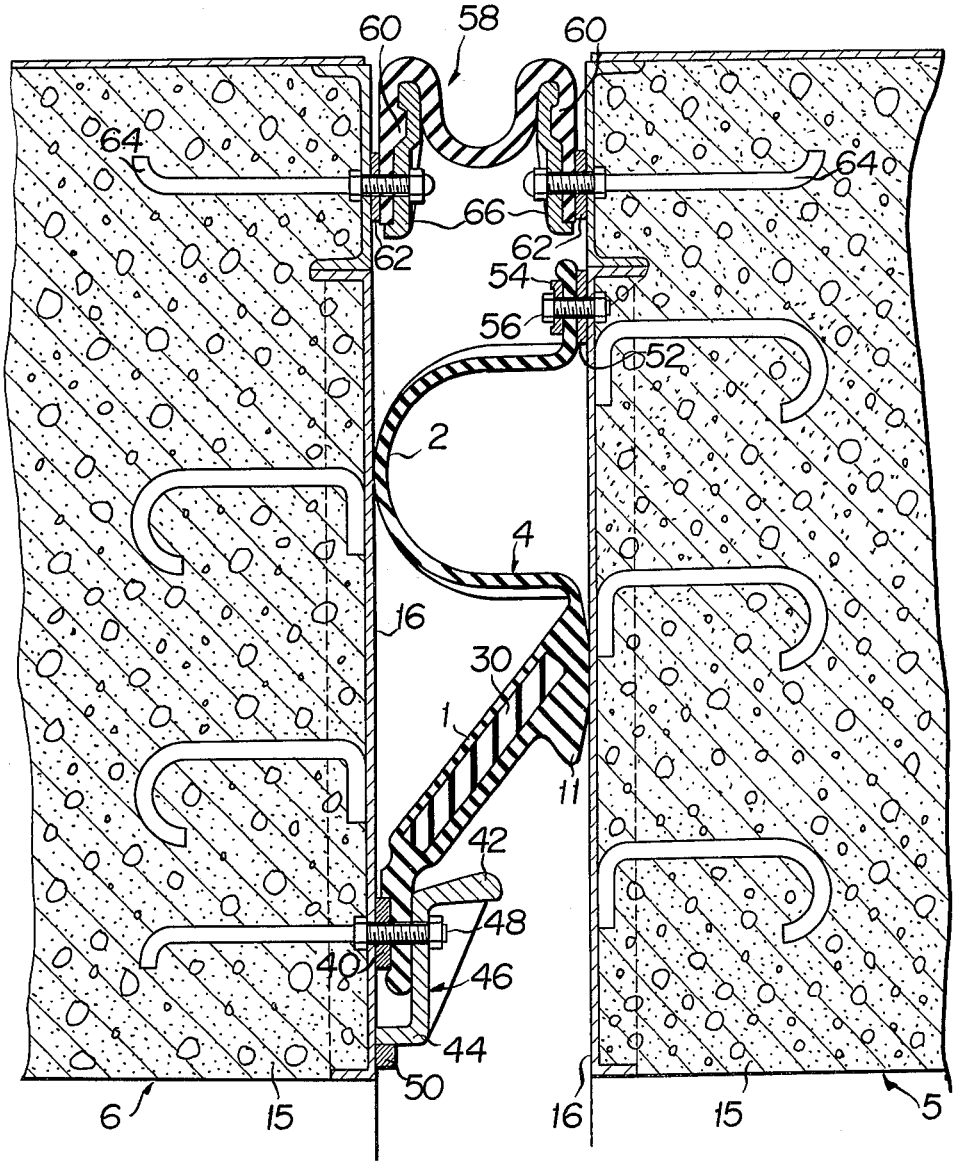
FIG. 11 is a longitudinal cross-sectional side view of underwater structures employing the water seal packing of FIG. 10.

FIG. 11 illustrates a water sealing expansible and contractible joint structure for two underwater structures employing the above-mentioned water seal packing 4. Disposed oppositely to each other at a space interval are square or four-cornered structures 5 and 6 each of which comprises a concrete body 15 and a metallic cover plate 16 fixedly secured thereto as an integral part thereof. A metallic strip-shaped bearing plate 40 extending along the entire periphery of the end face of opening of one underwater structure abuts against the end face and is fixedly secured thereto by welding. The strip-shaped bearing plate 40 is fitted into the groove 34 formed in the back surface of the base end flange 7. A stopper 42 for restricting standing oscillation disposed opposite to the base end side of the inclined intermediate body portion 1 abuts against a metallic retainer member 46 having a leg portion 44 along the entire length of the surface of the base end flange 7. The leg portion 44 of the retainer member 46 abuts against the end face of the underwater structure 6, and the base end flange 7 is fixedly secured through the retainer member 46 by tightening up an anchor bolt 48 adapted to be secured to the underwater structure 6. Further, fixedly secured to the end face of the underwater structure 6 is a stopper 50 disposed opposite to the leg portion 44.

A space or clearance is provided between the inclined intermediate body portion 1 and the stopper 42 for limiting standing oscillation, and also a space is provided between the base end of the inclined intermediate body portion 1 and the end face of the underwater structure 6.

Fixedly secured to the end face of the other underwater structure 5 is a strip-shaped bearing plate 52 against which a leading end flange 3 abuts. A strip-shaped metallic retainer member 54 abuts against the entire length of the leading end flange 3 which is fixedly secured by tightening up a bolt 56 through the retainer member 54. A sliding layer 12 is slidably engaged with the end face of the underwater structure 5. Disposed on the outer periphery of end faces of the openings of the underwater structures 5 and 6 is a U-shaped rubber primary water seal gasket 58 with flanges 60 on both sides thereof. The flanges 60 of the gasket 58 abut against strip-shaped bearing plates 60 fixedly secured to the underwater structures 5 and 6, and are secured to the latter through respective retainer members 66 by means of anchor bolts 64.

It is to be understood that the foregoing description is merely illustrative of the preferred embodiments of the present invention and that the scope of the invention is not to be limited thereto, but is to be determined by the scope of the appended claims.

What is claimed is:

1. A water seal packing for sealing water at the coupling portion of under water structures comprising first and second structures, each being disposed oppositely at the end thereof; said water seal packing comprising an intermediate body portion having a sliding surface at one end thereof, said intermediate body portion being disposed for inclination relative to the underwater structures and being bendable at a base end thereof; a first flange portion formed integrally with said intermediate body portion at the base end thereof, said first flange portion being fixedly secured to said first under water structure; a flexible U-shaped portion formed integrally with said intermediate body portion at the other end thereof adjacent to the sliding surface, said U-shaped portion having a plurality of wave-shaped sections or ridges formed thereon in a space apart relationship; and a second flange portion formed integrally with said U-shaped portion on the side opposite to said intermediate body portion, said second flange portion being fixedly secured to said second underwater structure wherein the sliding surface of said intermediate body portion is adapted to slide freely on the surface of said second structure.

2. A water seal packing of claim 1, wherein a fibre reinforced hard rubber is interposed in said intermediate body portion.

3. A water seal packing of claim 1, wherein the connecting portion between said intermediate body portion and said first flange portion has a thin wall to enhance flexibility of the connecting portion.

* * * * *